United States Patent [19]

Sullivan

[11] 4,132,045

[45] Jan. 2, 1979

[54] REINFORCING BAR SUPPORT

[75] Inventor: Ralph G. Sullivan, Birmingham, Ala.

[73] Assignee: The Dayton Sure-Grip & Shore Company, Miamisburg, Ohio

[21] Appl. No.: 845,902

[22] Filed: Oct. 27, 1977

[51] Int. Cl.[2] ..... E04C 5/16

[52] U.S. Cl. ..... 52/685; 52/686; 52/687

[58] Field of Search ..... 52/682, 684, 685, 686, 52/687, 688, 689

[56] References Cited

U.S. PATENT DOCUMENTS

| | | | |
|---|---|---|---|
| 1,257,616 | 2/1918 | Lampert | 52/684 |
| 1,440,464 | 1/1923 | Hough | 52/684 |
| 1,476,939 | 12/1923 | White | 52/686 |
| 2,272,761 | 2/1942 | Awbrey | 52/684 |
| 2,273,197 | 2/1942 | Hillberg | 52/688 |
| 2,409,342 | 10/1946 | Cassidy | 52/684 |
| 2,439,428 | 4/1948 | Hillberg | 52/686 |

*Primary Examiner*—Price C. Faw, Jr.
*Assistant Examiner*—Henry Raduazo
*Attorney, Agent, or Firm*—Biebel, French & Nauman

[57] ABSTRACT

A bar support for supporting a plurality of longitudinally extending reinforcing bars and a transversely extending reinforcing bar includes a cross rod which is positioned beneath the transversely extending reinforcing bar and extends along the bar in parallel relationship, and a plurality of bar support chair means which are laterally spaced along the cross rod. Each of the bar support chair means includes a first member having a first vertical leg portion extending above and displaced from the cross rod and a second member having a second vertical leg portion extending above and laterally displaced from the cross rod on the opposite side of the cross rod from the first leg portion. Longitudinally extending reinforcing bars are held between the leg portions transversely to the cross rod, and the transversely extending reinforcing bar is held between the leg portions parallel to the cross rod.

4 Claims, 7 Drawing Figures

REINFORCING BAR SUPPORT

BACKGROUND OF THE INVENTION

The present invention relates to reinforcing bar supports and, more particularly, to support structures capable of supporting reinforcing bars of the type used in continuously reinforced concrete pavement highways.

A continuous reinforcement technique of highway construction has been developed in which the highway lanes are poured with both transverse and longitudinally extending reinforcing bars imbedded in the concrete. The transverse reinforcing bars will generally extend across the entire width of the highway lane. The longitudinally extending reinforcing bars which extend along the highway lane are staggered in their relative positions such that there is no point along the pavement at which all of the bars imbedded therein will end. There are, therefore, no transverse joints to be sealed across the highway lanes, and motorists will experience a smoother ride.

It is necessary to position the reinforcing bars along the sub-base prior to pouring the concrete. Both longitudinal and transverse reinforcing bars must be held during the pouring process so that they will be positioned in the final poured pavement slab according to design specifications. A support structure for the reinforcing bars is therefore required which will be imbedded in the concrete slab. The support structure must hold both longitudinal and transverse bars firmly and, further, must be relatively inexpensive.

One commonly used arrangement for supporting the reinforcing bars in the desired positions during the pouring operation has been to weld a plurality of U-shaped clips at the desired positions along the length of each transverse reinforcing bar. The clips are provided to hold longitudinally extending bars which are laid across the tops of the transverse reinforcing bars. Each transverse reinforcing bar has two or more triangularly shaped metal bases welded to it for holding the resulting grid of reinforcing bars at the desired height. Since each support includes a transverse reinforcing bar, it is apparent that such supports will be relatively expensive. Furthermore, since the vertical positioning of the reinforcing bars, the diameters of the bars, and the spacing between longitudinal bars will vary, depending upon construction specifications, such support arrangements will necessarily be made to order and surplus supports will necessarily be scrapped.

A number of supports for concrete reinforcing rods have been designed in the past, although many, such as those shown in U.S. Pat. No. 3,132,448, issued May 12, 1964, to Phillips et al, and U.S. Pat. No. 2,273,197, issued Feb. 17, 1942, to Hillberg, are capable of supporting only reinforcing rods extending in one direction. It is desirable where both longitudinal and transverse reinforcing rods or bars are to be utilized that the bar support should be capable of supporting transversely oriented bars at their points of intersection.

Other bar supports, such as that shown in U.S. Pat. No. 1,476,939, issued Dec. 11, 1923, to White, have been used which are capable of supporting two reinforcing bars at their point of intersection but which supports cannot be easily interconnected with other similar bar supports. If a plurality of such individual bar supports were to be used, it would be necessary to check frequently the spacing between each adjacent longitudinally extending reinforcing bars. A much more desirable configuration would provide for interconnection of supports across the entire width of the lane so that the longitudinally extending reinforcing bars would necessarily be positioned the desired distance apart.

U.S. Pat. No. 2,439,428, issued Apr. 13, 1948, to Hillberg, shows a bar support structure in which bar supports are interconnected so that their relative spacing is held in fixed relation. This support arrangement is relatively complex in shape. Further, the supports are interconnected in both directions such that the transversely extending reinforcing bars are positioned with respect to each other, as well as the longitudinally extending reinforcing bars. This grid of supports would be relatively difficult to transport and impractical for support in a continuously reinforced construction application.

Accordingly, there is a need for a simple, inexpensive, reinforcing bar support arrangement which will accurately locate the longitudinally extending reinforcing bars with respect to each other and which may be simply and economically produced and transported to the construction site.

SUMMARY OF THE INVENTION

A bar support for supporting a plurality of longitudinally extending reinforcing bars and a transversely extending reinforcing bar such that the reinforcing bars are held in proper spaced relationship includes a cross rod and a plurality of bar support chair means which are laterally spaced along the cross rod. When the bar support is in use, the cross rod is positioned beneath and parallel to the transversely extending reinforcing bar and the bar support chair means each engage a longitudinally extending reinforcing bar and the transversely extending reinforcing bar.

Each bar support chair means includes a first chair member and a second chair member. The first chair member has a first vertical leg portion extending above and laterally displaced from the cross rod, a horizontally extending portion attached to the cross rod, and a downwardly extending support portion. Similarly, the second chair member has a second vertical leg portion extending above and laterally displaced from the cross rod on the opposite side of the cross rod from the first leg portion, a horizontally extending portion attached to the cross rod at a point adjacent that at which the first chair member is attached to the cross rod but spaced therefrom a distance greater than the diameter of a longitudinally extending reinforcing bar, and a downwardly extending support portion. The longitudinally extending reinforcing bars are held transversely to the cross rod between the leg portions, and the transversely extending reinforcing bar is held between the leg portions parallel to the cross rod.

Each of the first vertical leg portions may be dimensioned such that it extends above the horizontally extending portion a distance sufficient to permit the first vertical leg portion to be bent over the top of the reinforcing bars, engaging the reinforcing bars and holding them between the leg portions. The cross rod may extend either beneath or above the horizontally extending portions of the chair members on each of the bar support chair means.

DETAILED DESCRIPTION OF THE PREFERRED EMBODIMENTS

Figure 1:
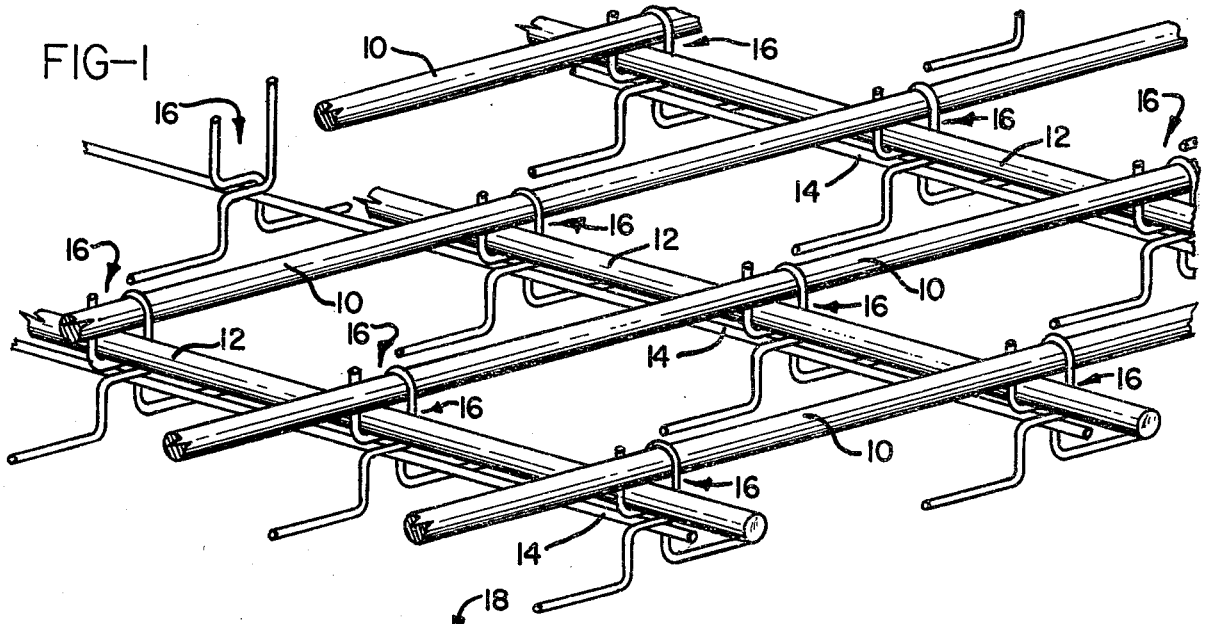
FIG. 1 is a perspective view showing the bar supports of the present invention in use.

Reference is made to FIG. 1 in which bar supports of the present invention are shown in perspective supporting a plurality of longitudinally extending reinforcing bars 10 and transversely extending reinforcing bars 12 so that they will be held in proper spaced relationship as a concrete pavement is poured. Each bar support includes a cross rod 14 which is positionable beneath a transversely extending reinforcing bar 12 such that it extends along the associated bar 12 in parallel relationship. A plurality of bar support chair means 16 are laterally spaced along each cross rod 14 and engage the longitudinally extending reinforcing bars 10 and the transversely extending reinforcing bars 12 at the points at which the longitudinally extending reinforcing bars 10 cross over the transversely extending reinforcing bars 12.

Figure 2:
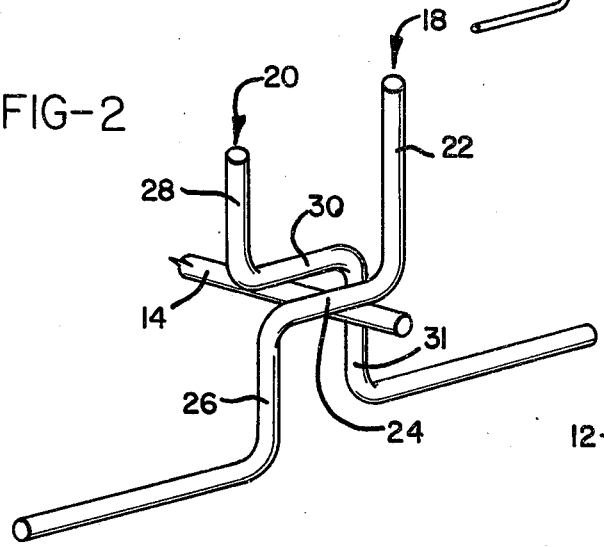
FIG. 2 is an enlarged perspective of one of the bar support chair means on the bar support.
Figure 3:
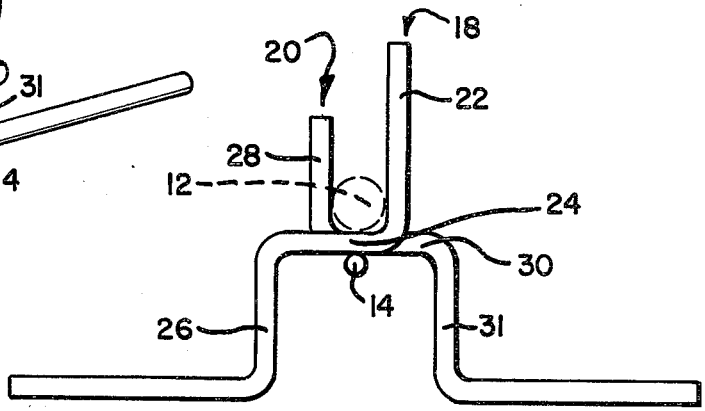
FIG. 3 is an end view of the bar support of the present invention, looking along the cross rod.
Figure 4:
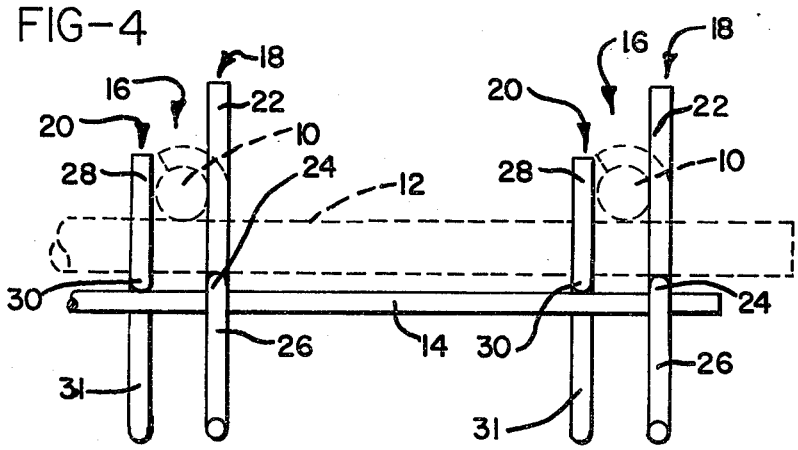
FIG. 4 is a side view of the bar support, as seen looking left to right in FIG. 3, illustrating the manner in which the reinforcing bars are engaged.

Reference is now made to FIGS. 2–4 in which the bar support chair means of one embodiment of the invention is more clearly illustrated. Each bar support chair means includes a first chair member 18 and a second chair member 20. The first and second chair legs and the cross rod 14 may typically be formed from wire stock, and the gauge of wire can be varied depending upon the load capacity required of the support because of the size and spacing of the reinforcing steel. In one construction the first and second chair members were formed from #5 gauge wire stock, approximately 0.207 inch in diameter, and the cross rod 14 was also cut from #5 gauge wire stock. First chair member 18 has a first vertical leg portion 22 extending above and laterally displaced from cross rod 14.

The first chair member includes a horizontally extending portion 24 which may be attached to cross rod 14 by welding, and a downwardly extending support portion 26 which will rest on the roadbed. The second chair member 20 has a second vertical leg portion 28 extending above and laterally displaced from cross rod 14 on the opposite side of cross rod 14 from the first leg portion 22.

The second chair member 20 further includes a horizontally extending portion 30 attached to cross rod 14 at a point adjacent that at which the first chair member 18 is attached to cross rod 14 but spaced therefrom by a distance greater than the diameter of a longitudinally extending reinforcing bar 10, as illustrated in FIG. 4. As seen in FIG. 3, the vertical leg portions 22 and 28 are laterally displaced on opposite sides of cross rod 14 by a distance at least as great as the diameter of a transversely extending reinforcing bar 12. The second chair member 20 further includes a downwardly extending portion 31.

Downwardly extending portions 26 and 31 are bent outwardly and are intended to rest upon the sub-base. If the roadbed is sufficiently soft, it may be desirable to add metal plates to portions 26 and 31 to prevent the bar supports from being depressed slightly into the bed by the weight of the reinforcing bars.

The bar support shown in FIGS. 2, 3 and 4 includes bar support chair means having first vertical leg portions 22 which extend above their associated horizontally extending portions 24 by a distance sufficient to permit the first vertical leg portions to be bent over the top of the reinforcing bars 10 and 12, engaging the reinforcing bars and holding the reinforcing bars between the leg portions 22 and 28.

Figure 5:
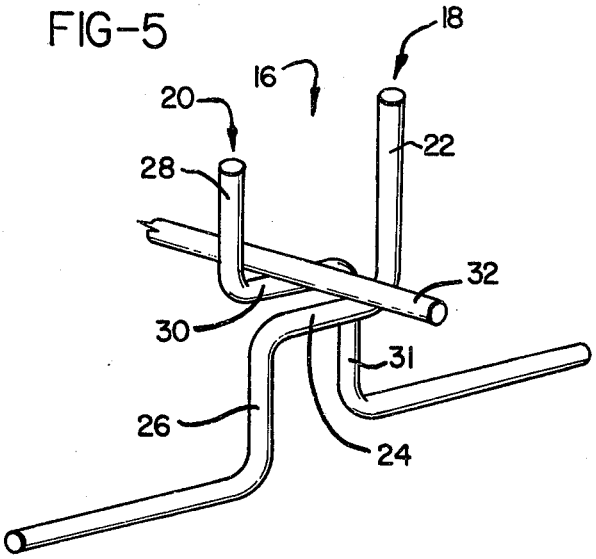
FIG. 5 is a perspective view of a portion of an alternative embodiment of the present invention.
Figure 6:
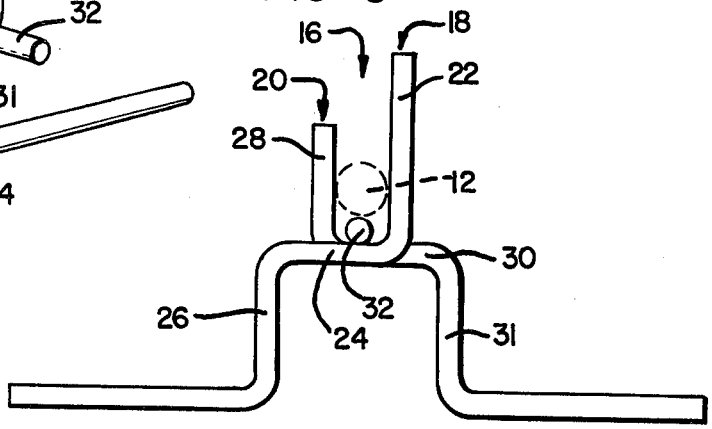
FIG. 6 is an end view of the support of FIG. 5, looking along the cross rod.
Figure 7:
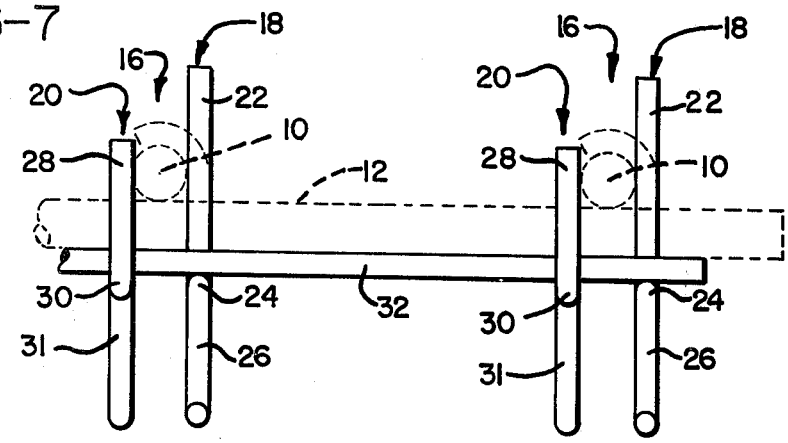
FIG. 7 is a side view of the bar support of FIG. 6, as seen looking left to right in FIG. 6, illustrating the manner in which the reinforcing bars are engaged.

Reference is now made to FIGS. 5, 6 and 7 in which an alternative embodiment of the support of the present invention is whown, with elements corresponding to those in the embodiment of FIGS. 2–4 being indicated with like reference numerals. In the bar support of FIGS. 2–4, cross rods 14 extend beneath the horizontally extending portions 24 and 30 of the bar members 18 and 20, respectively. In the bar support of FIGS. 5–7, however, a cross rod 32 is provided which extends above the horizontally extending portions 24 and 30 of the chair members. Since the transversely extending reinforcing bar 12 rests directly on top of cross rod 32, the small gap which exists between bar 12 and cross rod 14 in the embodiment of FIGS. 2–4 is eliminated. This gap may prove troublesome in some applications if it is not completely filled with concrete. The resulting air pockets may reduce the strength of the finished continuously reinforced concrete pavement slab.

While the forms of apparatus herein described constitute preferred embodiments of the invention, it is to be understood that the invention is not limited to these precise forms of apparatus and that changes may be made therein without departing from the scope of the invention.

What is claimed is:

1. A bar support for supporting a plurality of longitudinally extending reinforcing bars and a transversely extending reinforcing bar such that said reinforcing bars are held in proper spaced relationship, comprising:

a cross rod formed of wire stock, positionable beneath said transversely extending reinforcing bar and extending along said bar in parallel relationship, a plurality of bar support chair means, laterally spaced along said cross rod, for engaging said longitudinally extending reinforcing bars and said transversely extending reinforcing bar, each of said bar support chair means including:

a first chair member formed of wire stock having a first vertical leg portion extending above and laterally displaced from said cross rod, a horizontally extending portion welded to said cross rod, and a downwardly extending support portion, and a second chair member formed of wire stock having a second vertical leg portion extending above and laterally displaced from said cross rod on the opposite side of said cross rod from said first leg portion, a horizontally extending portion welded to said cross rod at a point adjacent that at which said first chair member is attached to said cross rod but spaced therefrom by a distance greater than the diameter of a longitudinally extending reinforcing bar, and a downwardly extending support portion, whereby the longitudinally extending reinforcing bars may be held between said leg portions transversely to said cross rod, and said transversely extending reinforcing bar may be held between said leg portions parallel to said cross rod.

2. The bar support of claim 1 in which each of said first vertical leg portions extends above said horizontally extending portion a distance sufficient to provide for bending said first vertical leg portion over the top of the reinforcing bars, engaging the reinforcing bars and holding the reinforcing bars between said leg portions.

3. The bar support of claim 1 in which said cross rod extends beneath said horizontally extending portions of said chair members on each of said bar support chair means.

4. The bar support of claim 1 in which said cross rod extends above said horizontally extending portions of said chair members on each of said bar support chair means.

* * * * *